US006013315A

United States Patent [19]

Mandal

[11] Patent Number: 6,013,315

[45] Date of Patent: Jan. 11, 2000

[54] DISPENSE NOZZLE DESIGN AND DISPENSE METHOD

[75] Inventor: Robert P. Mandal, Saratoga, Calif.

[73] Assignee: Applied Materials, Inc., Santa Clara, Calif.

[21] Appl. No.: 09/010,887

[22] Filed: Jan. 22, 1998

[51] Int. Cl.[7] ..... B05D 3/12; B05C 11/02; B67D 3/00

[52] U.S. Cl. ..... 427/240; 118/52; 118/320; D23/213; 222/526; 222/533; 427/385.5; 427/422

[58] Field of Search ..... 427/240, 422, 427/385.5; 437/231; 118/52, 620; D23/215; 222/526, 533

[56] References Cited

U.S. PATENT DOCUMENTS 5,094,884 3/1992 Hillman ..... 427/240

5,127,362 7/1992 Iwatsu et al. ..... 118/67

*Primary Examiner*—Janyce Bell

*Attorney, Agent, or Firm*—Robert W. Mulcahy

[57] ABSTRACT

A dispense nozzle (10), having a narrow oblong orifice (14), is positioned over and near the surface of the substrate (22), close to the edge of the substrate. While the substrate is rotating, the nozzle dispenses fluid through the narrow oblong orifice onto the substrate surface, starting from near the outer edge (24) moving toward the substrate's rotational center (26). The narrow oblong orifice may have lips of unequal size to help direct fluid flow. A controlled rate of acceleration is maintained for the rate of translation of the nozzle across the substrate surface. Once the nozzle approaches the substrate's rotational center, the nozzle is raised to a higher height above the surface of the substrate while continuing to dispense fluid. Then the dispense stream of fluid is terminated, and the substrate is rapidly accelerated to a predetermined spin speed to evenly distribute the fluid over the surface of the substrate to a uniform film of desired thickness.

30 Claims, 2 Drawing Sheets

DISPENSE NOZZLE DESIGN AND DISPENSE METHOD

FIELD OF THE INVENTION

The present invention relates to a nozzle in general, and more specifically to an improved dispense nozzle design and dispense method for applying polymer fluid films onto rotating substrates to form uniform film coatings on the surfaces of the substrates.

BACKGROUND OF THE INVENTION

Integrated circuit (IC) fabrication is based upon the formation of precise patterns upon the surface of substrates, typically silicon wafers, using photolithography. The formation of precise photolithographic patterns is dependent upon the application of uniform films of photosensitive materials, also known as photoresist. Photoresist is applied as a light sensitive polymer coating to protect selected areas on a substrate during subsequent chemical treatments. Photoresist can be either negative-acting or positive-acting. With negative-acting photoresist, the coating remains in the light-struck areas. Positive-acting photoresist is the converse. Regardless of the type of photoresist used in the IC fabrication process, a uniform coating of the photoresist is very important because the thickness of this photoreactive layer can impact subsequent processing steps.

Several dispensing methods have been employed to apply liquid photoresist onto wafer substrates. Typically, spinning wafers are flooded with photoresist, dispensed from nozzles in a wafer track system. These dispense nozzles all have orifices with circular cross sections. The wafers are then subjected to high acceleration to evenly distribute the photoresist over the wafer surfaces.

In one prior art method called the center dynamic dispense, the dispense nozzle is held above the spin axis of the wafer substrate, and photoresist is dispensed from the nozzle onto the spinning substrate. Once the wafer substrate is flooded with the photoresist, it is rapidly accelerated to a predetermined spin speed to spread the photoresist into a uniform film at the desired thickness. During this high acceleration, about 96% of the photoresist is normally flung off the wafer.

In another prior art method called the center static dispense, the wafer substrate is held motionless while photoresist is dispensed at the center of the substrate. The substrate is then subjected to a high acceleration to cause the photoresist to spread to a uniform film at the desired thickness. Excess photoresist is again flung off the wafer.

In yet another method, the dispense nozzle is scanned across the spinning substrate while dispensing photoresist. The substrate is flooded with photoresist and then subjected to high acceleration to a predetermined spin speed to form a film of uniform thickness at the desired thickness. This method is called the reverse/forward radial dynamic dispense depending on the direction of nozzle translation across the substrate.

All of these prior art methods depend upon the application of relatively large volumes of photoresist in order to achieve films of uniform thickness. Radial dynamic dispensing helps to spread material across the substrate somewhat. As presently practiced, however, the fluid flow onto the substrate is not smooth; the uniformity of the fluid spread the during dispense is poor; and relatively large excess volumes of fluid are required to achieve acceptable film thickness uniformities. In addition to these disadvantages, the cost of the photoresist material has greatly increased for new generation deep-ultraviolet (DUV) technology for finer pattern feature dimensions. To this substantially increased material cost must be added the cost of hazardous waste material disposal.

Hence, a need exists for a nozzle and a method for dispensing photoresist that delivers a uniform layer of photoresist while reducing waste.

SUMMARY OF THE INVENTION

A dispense nozzle is fabricated with a narrow oblong orifice. The nozzle is positioned over the surface of the substrate to be coated and in close proximity thereto. While the substrate is rotating, the nozzle dispenses fluid, starting from near the outer edge of the substrate moving toward the rotational center of the substrate. Once the nozzle approaches the rotational center of the substrate, the nozzle is raised to a higher height above the surface of the substrate while continuing to dispense fluid. Then the dispense stream of fluid is cut off, and the substrate is rapidly accelerated to a predetermined spin speed to evenly distribute the fluid over the surface of the substrate to a uniform film of desired thickness. Practicing the invention significantly reduces expensive polymer fluid consumption while preserving film thickness uniformity required for IC applications.

These and other features, and advantages, will be more clearly understood from the following detailed description taken in conjunction with the accompanying drawings. It is important to point out that the illustrations may not necessarily be drawn to scale, and that there may be other embodiments of the present invention which are not specifically illustrated. Furthermore, as the figures may illustrate the same or substantially similar elements, like reference numerals will be used to designate elements that are the same or substantially similar in either shape or function.

DETAILED DESCRIPTION OF A PREFERRED EMBODIMENT

Figure 1:
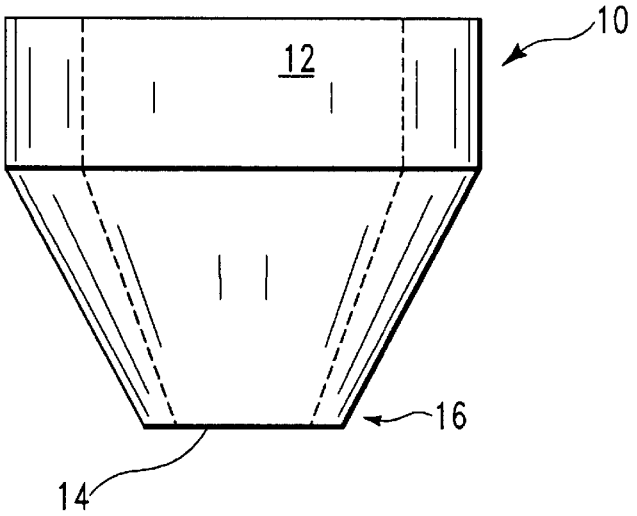
FIG. 1 illustrates, in a side view, a nozzle having a narrow oblong orifice in accordance with an embodiment of the present invention.
Figure 2:
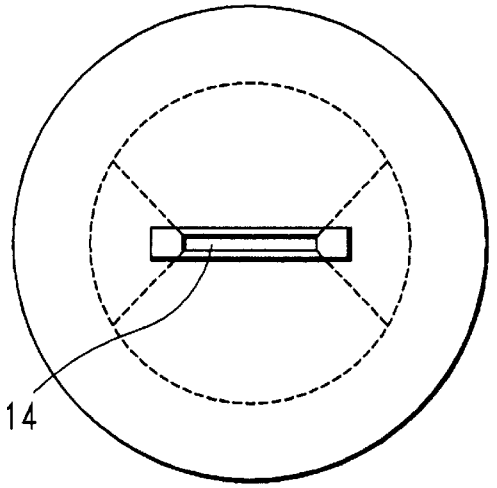
FIG. 2 illustrates, in a bottom view, the nozzle of FIG. 1, wherein the narrow oblong orifice is rectangular.
Figure 3:
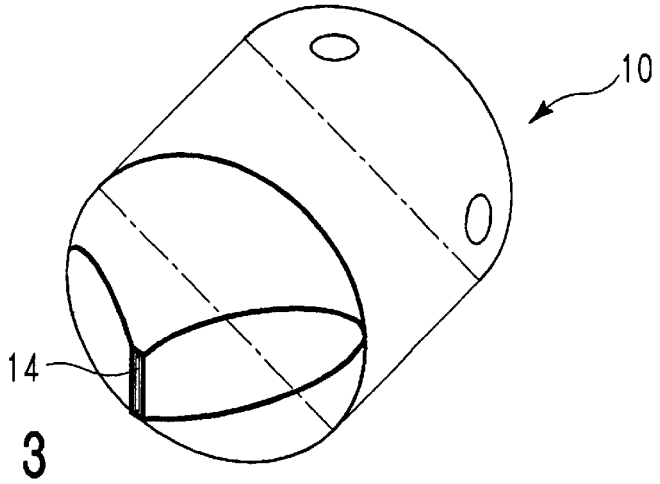
FIG. 3 illustrates, in a perspective view, the nozzle of FIG. 1.

FIG. 1 illustrates a nozzle 10 having a narrow oblong orifice 14 in an embodiment of the present invention. FIG. 2 illustrates a bottom view of the nozzle 10, and FIG. 3 illustrates a perspective view of the nozzle 10. Nozzle 10 may be used to dispense a fluid, which may be, but is not limited to, a photosensitive polymer fluid, such as photoresist. The nozzle 10 should be fabricated using a chemicallyresistant material that is not wettable by the fluid being dispensed to reduce the likelihood of post-dispense drip. Fluorinated ethylene propylene (FEP) is preferred because it has good stability and a high flow rate for injection molding. Alternatively, polytetrafluoroethylene (PTFE) may be used. Both of these materials are chemically inert to most industrial chemicals and solvents. This characteristic is desirable because although many different types of photoresists are available, most liquid photoresists contain at least a film-forming resin and a solvent system. These plastics are also advantageous in that they are translucent, thus allowing the user to see the fluid volume in the dispense nozzle to verify that there is sufficient "suckback" volume in the nozzle. "Suckback" is a term used to describe the procedure of polymer fluid being slightly withdrawn from the orifice at the conclusion of the fluid dispense. The above-mentioned plastics are also easily molded, yielding smooth molded surfaces. Smooth surfaces are desirable for better fluid flow.

Figure 4:
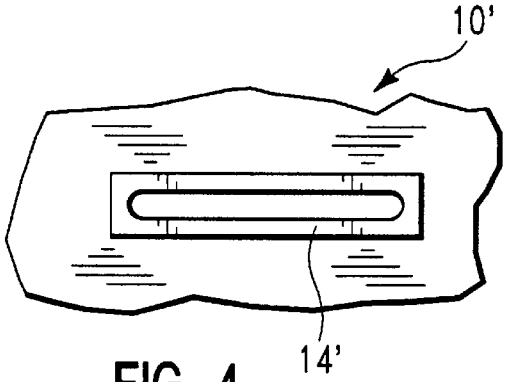
FIG. 4 illustrates a close-up detail of the narrow oblong orifice having a generally rectangular shape with rounded corners, in another embodiment of the present invention.
Figure 5:
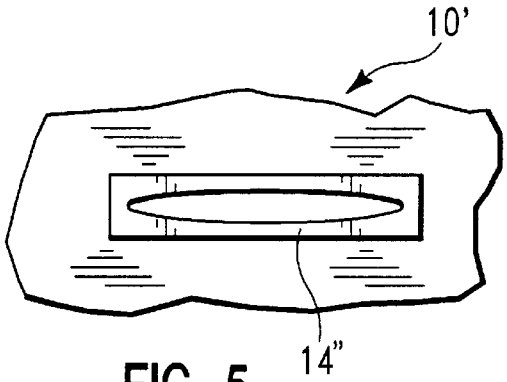
FIG. 5 illustrates a close-up detail of the narrow oblong orifice having a generally elliptical shape, in yet another embodiment of the present invention.

The nozzle 10 has a feed channel 12 which terminates into the narrow oblong orifice 14 which is a narrow slot at the dispense end 16 of the nozzle 10. The narrow oblong orifice 14 may be characterized either generally rectangular (FIGS. 2 & 4) or elliptical (FIG. 5) in shape. As illustrated in FIG. 4, the narrow rectangular orifice 14' may have optionally rounded corners, such that it generally resembles a modified or flattened ellipse having two long parallel sides connected by arcuate portions. Alternatively, the narrow oblong orifice 14" may be a general ellipse, as illustrated in FIG. 5. In either embodiment, rounding the comers of the narrow oblong orifice mitigates turbulent fluid flow near the narrow ends, thus reducing overspray of the fluid.

The narrow oblong orifice 14 (14', 14") has an aspect ratio that is greater than 1:1. For purposes of the present invention, the aspect ratio is defined in the following way. The narrow oblong orifice has a point of symmetry at its center which is called the center of symmetry. Two perpendicularly intersecting lines through this center of symmetry define the major axis and minor axis of the narrow oblong orifice. The aspect ratio is defined as the ratio of the major axis to the minor axis. Thus, for a rectangular orifice or a rectangular orifice with rounded corners, such as those illustrated in FIGS. 2 & 4, the aspect ratio is the ratio of the length to the width. For an elliptical orifice as illustrated in FIG. 5, the aspect ratio is the ratio of the major axis to the minor axis. It is noted that nozzles of the prior art, having circular orifices, necessarily have aspect ratios of 1:1 regardless of the size of the orifice.

A narrow oblong orifice having an aspect ratio of about 8:1 to about 16:1 is preferred because it achieves the desired extrusion and spreading characteristics for photoresist and is convenient to manufacture, either through standard mechanical machining or laser machining. However, aspect ratios ranging from about 4:1 to about 24:1 is acceptable for dispensing most polymer fluids.

Referring back to FIG. 1, the cross-sectional area of the feed channel 12 increases in size in the direction away from the dispense end 16. The feed channel 12 may be designed as a series of truncated pyramidal segments (as illustrated) or it may have continuous tapered walls. This truncating feature allows substantial suckback volume, approximately ¼ ml, so that the fluid can be pulled back into the nozzle without trapping air.

An advantage of the narrow oblong orifice design of the present invention is that fluid basically can be extruded in a ribbon-like stream onto the substrate. The ribbon-like stream allows better coverage of the substrate surface with less material. Another advantage associated with the narrow oblong orifice is that the aspect ratio of the orifice can be varied to achieve the desired extrusion ribbon and to achieve the desired spreading characteristics of the fluid.

Figure 6:
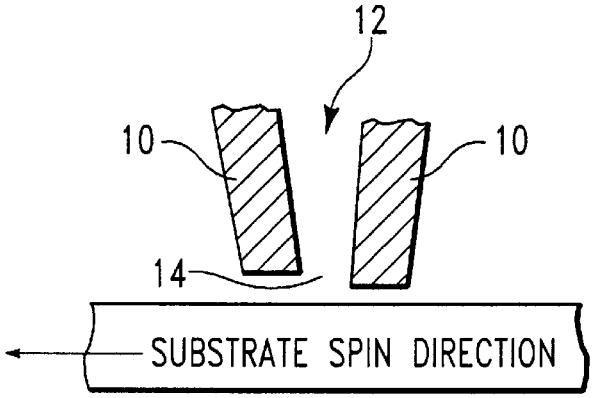
FIG. 6 illustrates an enlarged cross-sectional view of orifice lips having unequal sizes, in accordance with the invention.

For best dispense characteristics, the internal surfaces and orifice lip surface should be smooth, and the orifice lip dimensions should be a practical minimum. Thinner lip dimensions provide for better spreading of the fluid as it is being dispensed. If the lips are too thin, however, they can be easily damaged. It may also be desirable to have orifice lips of unequal sizes, as illustrated in FIG. 6, to help direct the flow of the fluid onto the substrate.

The nozzle 10 of the present invention was reduced to practice using a clear Teflon® FEP material that is commercially available. The narrow oblong orifice measured about 4.00 mm×0.50 mm (aspect ratio of 8:1), with the orifice lip fabricated at a practical minimum, about 0.1 mm. The corners of the orifice were rounded. The feed channel to the orifice was designed as truncated pyramidal segments, increasing in cross-section in the direction away from the orifice, to help suckback adjustment and control. All internal surfaces were smooth and transparent. This embodiment was used to reduce to practice a method of the present invention, as discussed in greater detail below.

It should be noted that the particular dimensions and design of the narrow oblong orifice 14 can vary depending on the user's applications. Variables to consider in designing the orifice of the nozzle include: the separation distance from the nozzle to the substrate to be coated, the rotational speed of the substrate during dispense, the rate of translation of the dispense arm; the fluid temperature, the temperature of the substrate, the dispense rate of the fluid, and the rheology of the dispensed fluid. Thus, the dimensions of the nozzle orifice can be changed depending upon the characteristics of the dispensed fluid and the other variables.

Figure 7:
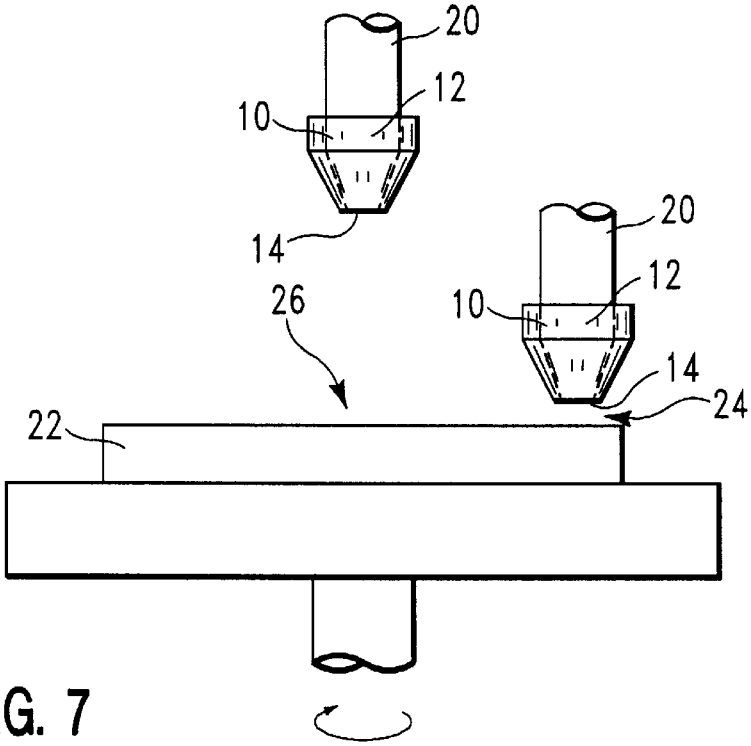
FIG. 7 illustrates a nozzle of the invention in use, in accordance with a method of the present invention.

As stated above, the nozzle 10 can be used to dispense a fluid onto a substrate. FIG. 7 illustrates the nozzle 10 being attached to a dispense arm 20. The nozzle feed channel 12 is perpendicular to the substrate 22, and the major axis of the narrow oblong orifice 14 is aligned substantially parallel to the substrate radius when the nozzle 10 is near the outer edge of the substrate 22. The substantially parallel alignment of the major axis of the narrow oblong orifice to the substrate radius is important near the edge of the substrate, for optimum spread efficiency, but decreases in importance toward the center of the substrate. Therefore, either a translational or a rotational dispense arm sweep trajectory, or a combination thereof, may be used.

The nozzle 10 is positioned above and in close proximity to the surface of the substrate 22 at a position 24 near, but not necessarily at, the edge of the substrate. The separation distance between the nozzle and the substrate surface should be no more than about 2 mm, or for example about 0.8 mm to 1.2 mm, for best extrusion results of a polymer fluid. The substrate 22 is rotated at a first rotational or spin speed for the dispensing step. Using a smooth sweeping motion, the nozzle 10 is moved, via moving the dispense arm 20, across the substrate 22 to the rotational center 26 of the substrate while the nozzle 10 dispenses the fluid through the narrow oblong orifice 14. To maintain the desired smooth sweeping motion, the dispense arm should be moved with a speed having a controlled rate of acceleration. The acceleration can be zero for constant speed, positive for increasing speed, or negative for decreasing speed. During this step, the nozzle's narrow oblong orifice 14 is in close proximity to the substrate surface, such that the polymer is essentially extruded onto the substrate surface. It is possible to change the fluid dispense rate as the nozzle moves from the edge of the substrate to its rotational center if doing so would yield the desired spreading characteristic for the particular fluid being dispensed.

Upon nearly reaching the substrate spin axis or rotational center 26, the nozzle 10 is rapidly raised to a higher position above the substrate surface while continuing to dispense the fluid. Raising the nozzle 10 to the increased height while continuing to dispense the fluid allows the ribbon-like fluid stream to coalesce and transition into a stream with a circular cross-section when flowing onto the substrate 22 at its rotational center 26. For radially symmetric flow across the substrate, this step aids film thickness uniformity. Finally the dispense stream is abruptly cut off, and the substrate 22 is rapidly accelerated to a predetermined second spin speed to distribute the fluid into a uniform film at the desired thickness.

In a reduction to practice, the Teflon® FEP nozzle described above was used to dispense photoresist onto a semiconductor wafer. The nozzle was attached to the dispense arm such that the nozzle channel was perpendicular to the wafer. The nozzle was positioned near, but not at, the edge of the wafer with the major axis of the 4 mm×0.5 mm oblong orifice initially aligned substantially parallel to the wafer radius at a height of about 1 mm above the wafer surface. The wafer was rotating at a first speed. Using a smooth sweeping motion with a constant speed, the nozzle was then swept across the rotating wafer from near the edge to the rotational center of the wafer as photoresist was being dispensed from the nozzle. Dispense arm alignment along the horizontal plane (i.e., angle on the x-y axes along the wafer surface) was such that the minor axis of the dispensed fluid stream was directed within ±6° of the direction of wafer rotation at the point of contact, when the nozzle was positioned near the edge of the wafer. The alignment tolerance was linearly relaxed toward the center of the wafer. The nozzle-to-wafer spacing was controlled at 1.0 mm±0.1 mm during this sweep. This technique resulted in a smooth and fairly well-spread photoresist layer on the wafer surface just from the dispense step alone.

Upon nearly reaching the wafer spin axis, the nozzle was rapidly raised to a height of about 2 cm above the wafer surface while continuing to dispense photoresist. Raising the nozzle to this increased height while continuing to dispense the photoresist liquid allowed the fluid to coalesce into a stream with a circular cross section as it flowed onto the wafer surface at the wafer's rotational center. This step appeared to aid the uniformity of the photoresist film as expected. Finally the dispense stream was abruptly terminated, and the wafer was rapidly accelerated to a given second spin speed to form the thin-film coating at the desired thickness.

Practicing the above method resulted in a smooth, well-spread photoresist layer to the wafer substrate and consequently permitted significantly less photoresist to be dispensed while preserving film thickness uniformity. It should be noted that any tendency of undesirable dripping of photoresist from the dispense nozzle was made less likely by the non-wetting narrow gap of the narrow slotted oblong orifice.

Although an embodiment of the invention has been reduced to practice to dispense photoresist, the present invention can also be used in any thick-film or thin-film processes where spin coating is used to deposit a liquid material. For example, low dielectric constant polymer materials are being developed to replace silicon dioxide for multilevel interconnections for improved integrated circuit electrical performance. These low dielectric constant materials are also applied as polymer fluids spin cast onto wafers, very much in the same manner as photoresist materials. Polyimides, often used in IC packaging processes, are other materials that are spin coated onto wafer substrates. Hence, the present invention may be used in conjunction with these materials.

The foregoing description and illustrations contained herein demonstrate many of the advantages associated with the present invention. In particular, it has been revealed that a nozzle having a narrow oblong orifice can be used to dispense a fluid. The present invention offers significant improvements over the prior art in that the design allows a polymer fluid to be effectively extruded onto the surface of a substrate. The ribbon-like fluid stream efficiently spreads over the substrate surface during dispense. An added benefit is that less polymer fluid is required during dispense to achieve a uniform film of desired thickness, thus saving in materials cost as well as hazardous material disposal cost. Moreover, the orifice dimensions can be varied depending on the characteristics of the dispense fluid for optimal spreading characteristics. Yet another advantage of the present invention is that any tendency of undesirable dripping of fluid from the dispense nozzle is made less likely by the non-wetting narrow gap of the orifice.

Thus, it is apparent that there has been provided, in accordance with the invention, a dispense nozzle and a method for using the same that substantially meet the need and advantages set forth previously. Although the invention has been described and illustrated with reference to specific embodiments thereof, it is not intended that the invention be limited to these illustrative embodiments. Those skilled in the art will recognize that modifications and variations can be made without departing from the spirit of the invention. For example, the specific narrow oblong shape of the orifice may be modified to something other than generally rectangular or elliptical and yet may still be characterized as a narrow slot. Additionally, more than one nozzle may be employed where multiple fluids are to be dispensed. Furthermore, it is possible to have a nozzle with multiple orifices. In this case, the sizes of the orifices can be different within the single nozzle to achieve the desired extrusion and spreading pattern of the fluid on the particular substrate to be coated. It is also possible to have a nozzle with both circular and oblong orifices. In addition, the present invention is not limited to the dispense of liquids, as suspensions and gases may also be sprayed. It is also important to note that practice of the present invention is not limited in any way to the dimensions disclosed. Therefore, it is intended that this invention encompass all such variations and modifications falling within the scope of the appended claims.

What is claimed is:

1. A nozzle for dispensing fluid, comprising:

a fluid channel extending between an inlet and an oblong orifice outlet, the fluid channel being generally oblong in cross section and tapering from the oblong orifice to the inlet of the channel.

2. A nozzle according to claim 1, wherein the inlet has a circular cross section.

3. A nozzle according to claim 1, wherein the oblong orifice has a cross section substantially smaller than the cross section of the inlet.

4. A nozzle for dispensing fluid, comprising:

a fluid channel extending between an inlet and an oblong orifice outlet, the fluid channel comprising a plurality of truncated pyramidal segments increasing in cross section from the oblong orifice toward the inlet of the channel.

5. A method for dispensing a fluid onto a substrate, comprising the steps of:

providing a nozzle having an oblong orifice at a dispense end of the nozzle;

positioning the nozzle above and in close proximity to a surface of a rotating substrate at a position near an outer edge of the rotating substrate;

moving the nozzle across the surface of the rotating substrate from the position near the outer edge to a position near a rotational center of the rotating substrate while concurrently dispensing a fluid from the oblong orifice of the nozzle; and raising the nozzle to a higher position relative to the surface of the rotating substrate when the nozzle is near the rotational center of the rotating substrate while continuing to dispense the fluid.

6. A method according to claim 5, wherein the raising step comprises raising the nozzle to a height above the surface of the substrate that is large enough so that the fluid dispensed from the orifice coalesces into a stream having a circular cross section above the surface of the substrate.

7. The method of claim 5, wherein the step of positioning the nozzle places the narrow oblong orifice at about 0.8 mm to about 1.2 mm above the surface of the rotating substrate, wherein the narrow oblong orifice has an aspect ratio ranging from about 8:1 to about 16:1.

8. The method of claim 5, wherein the step of positioning the nozzle at the position near the outer edge of the rotating substrate aligns the long axis of the narrow oblong orifice substantially parallel to a radius of the rotating substrate.

9. The method of claim 5, wherein the step of moving the nozzle is performed at a speed having a controlled rate of acceleration.

10. The method of claim 5, wherein the step of dispensing the fluid dispenses a polymer selected from a group consisting of photoresist materials, low dielectric constant polymer materials, and polyimides.

11. The method of claim 5, wherein the step of dispensing the fluid dispenses a fluid stream with a minor axis of said fluid stream directed within about 6 degrees of the direction of rotation of the rotating substrate.

12. The method of claim 5, wherein the step of raising the nozzle when near the rotational center of the substrate places the narrow oblong orifice at about 2 cm above the surface of the rotating substrate.

13. A method for coating a semiconductor substrate, comprising the steps of:

rotating a semiconductor substrate at a first rotating speed;

positioning a nozzle, having a narrow slotted orifice at a dispense end of the nozzle, above and in close proximity to a surface of the semiconductor substrate at a position near an outer edge of the semiconductor substrate;

moving the nozzle across the surface of the semiconductor substrate from the position near the outer edge to a rotational center of the semiconductor substrate, while rotating the semiconductor substrate;

concurrently dispensing a fluid from the narrow slotted orifice of the nozzle while moving the nozzle across the surface of the semiconductor substrate;

raising the nozzle to a higher position relative to the surface of the semiconductor substrate once the nozzle is near the rotational center of the semiconductor substrate while dispensing the fluid;

terminating the step of dispensing the fluid once the nozzle is in the higher position; and rotating the semiconductor substrate at a second rotating speed to spread the fluid over the surface of the semiconductor substrate into a uniform fluid film.

14. The method of claim 13, wherein the step of dispensing the fluid dispenses a polymer selected from a group consisting of photoresist materials, low dielectric constant polymer materials and polyimides.

15. The method of claim 13, wherein the step of positioning the nozzle at the position near the outer edge of the semiconductor substrate aligns a major axis of the narrow slotted orifice substantially parallel to a radius of the semiconductor substrate.

16. The method of claim 13, wherein the step of positioning the nozzle positions a shorter lip edge of the narrow slotted orifice toward the semiconductor substrate's spin direction.

17. Apparatus for dispensing fluid onto a rotating substrate, comprising:

means for rotating the substrate about an axis of rotation;

a nozzle positioned adjacent the substrate, the nozzle having an oblong orifice through which the nozzle dispenses said fluid, and the nozzle being movable between a position near the axis of rotation and a position near the periphery of the substrate; and means for changing the distance between the nozzle and the substrate while the nozzle moves between said two positions so that said position near the axis of rotation and said position near the periphery are first and second distances from the substrate, wherein the first distance is substantially greater than the second distance.

18. An apparatus according to claim 17, wherein the first distance is large enough so that the fluid dispensed from the orifice coalesces into a stream having a circular cross section above the surface of the substrate.

19. An apparatus according to claim 18, wherein the second distance is too small for the fluid dispensed from the orifice to coalesce into a stream having a circular cross section.

20. An apparatus according to claim 18, wherein the second distance is sufficiently small that the fluid dispensed from the orifice is extruded onto the substrate.

21. A method for dispensing fluid onto a rotating substrate, comprising the steps of:

rotating the substrate about an axis of rotation;

dispensing said fluid onto the substrate from an oblong orifice of a nozzle positioned adjacent the substrate; and concurrently with the dispensing step, moving the orifice between a position near the axis of rotation and a position near the periphery of the substrate;

wherein said position near the axis of rotation and said position near the periphery are first and second distances from the substrate, and the first distance is substantially greater than the second distance.

22. A method according to claim 21, wherein the first distance is large enough so that the fluid dispensed from the orifice coalesces into a stream having a circular cross section above the surface of the substrate.

23. A method according to claim 22, wherein the second distance is too small for the fluid dispensed from the orifice to coalesce into a stream having a circular cross section.

24. A method according to claim 22, wherein the second distance is sufficiently small that the fluid dispensed from the orifice is extruded onto the substrate.

25. Apparatus for dispensing fluid onto a rotating substrate, comprising:

means for rotating the substrate about an axis of rotation;

a pivoted arm that pivots about a pivot point; and a nozzle having an oblong orifice through which the nozzle dispenses said fluid, the orifice being elongated along a major axis, and the orifice being mounted on the pivoted arm so that, when the arm pivots, the orifice moves along an arcuate path;

wherein the pivoted arm is positioned so that said major axis is more closely parallel to a radius of the substrate when the pivoted arm moves the orifice near the perimeter of the substrate than when the pivoted arm moves the orifice near the axis of rotation of the substrate.

26. A method for dispensing fluid onto a rotating substrate, comprising the steps of:

rotating the substrate about an axis of rotation;

positioning near the substrate a pivoted arm that pivots;

mounting on the arm a nozzle having an oblong orifice that is elongated along a major axis, the orifice being mounted on the arm so that, when the arm pivots, the orifice moves along an arcuate path; and dispensing said fluid through the orifice while pivoting the arm;

wherein the positioning step further comprises positioning the arm so that said major axis is more closely parallel to a radius of the substrate when the arm moves the orifice near the perimeter of the substrate than when the arm moves the orifice near the axis of rotation of the substrate.

27. Apparatus for dispensing fluid onto a rotating substrate, comprising:

means for rotating the substrate; and a nozzle having first and second lips separated by an oblong orifice through which the nozzle dispenses said fluid, the orifice being elongated along a major axis, and the first and second lips being located at first and second opposite sides of the major axis;

wherein the orifice is oriented so that the portion of the substrate that, at any instant in time, is closest to the orifice has a direction of motion pointing from the first side of the major axis to the second side of the major axis; and wherein the first lip extends closer to the substrate than the second lip.

28. An apparatus according to claim 27, wherein the orifice is oriented so that the major axis of the orifice is perpendicular to said direction of motion.

29. A method for dispensing fluid onto a rotating substrate, comprising the steps of:

rotating the substrate;

dispensing said fluid through a nozzle having first and second lips separated by an oblong orifice, wherein the orifice is elongated along a major axis, the first and second lips are located at first and second opposite sides of the major axis, and the first lip extends closer to the substrate than the second lip; and orienting the orifice so that the portion of the substrate that, at any instant in time, is closest to the orifice has a direction of motion pointing from the first side of the major axis to the second side of the major axis.

30. A method according to claim 29, wherein the orienting step further comprises:

orienting the orifice so that the major axis of the orifice is perpendicular to said direction of motion.

* * * * *